US011703797B2

(12) United States Patent
Nakamoto

(10) Patent No.: US 11,703,797 B2
(45) Date of Patent: Jul. 18, 2023

(54) IMAGE FORMING APPARATUS WITH FAN FOR COOLING DISCHARGED SHEET

(71) Applicant: KYOCERA Document Solutions Inc., Osaka (JP)

(72) Inventor: Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/752,818

(22) Filed: May 24, 2022

(65) Prior Publication Data

US 2022/0404762 A1 Dec. 22, 2022

(30) Foreign Application Priority Data

Jun. 22, 2021 (JP) ..... 2021-102930

(51) Int. Cl.
*G03G 21/00* (2006.01)
*G03G 21/20* (2006.01)
*G03G 15/00* (2006.01)

(52) U.S. Cl.
CPC ..... *G03G 21/206* (2013.01); *G03G 15/6573* (2013.01); *G03G 2221/1645* (2013.01)

(58) Field of Classification Search
CPC ..... G03G 15/6573; G03G 21/206; G03G 2215/00417; G03G 2221/1645
USPC ..... 399/92, 341, 405
See application file for complete search history.

(56) References Cited

U.S. PATENT DOCUMENTS

2006/0263129 A1* 11/2006 Won ..... G03G 15/6552 399/405
2007/0059023 A1* 3/2007 Koshida ..... G03G 15/6573 399/92
2007/0059024 A1* 3/2007 Kitayama ..... G03G 15/2039 399/92
2014/0169850 A1* 6/2014 Matsuo ..... G03G 15/2039 399/341
2015/0093142 A1* 4/2015 Nogami ..... G03G 21/206 399/92
2019/0294084 A1* 9/2019 Suzuki ..... G03G 15/2017
2020/0223652 A1* 7/2020 Morita ..... B65H 29/247
2020/0278634 A1* 9/2020 Mizuta ..... B65H 85/00

FOREIGN PATENT DOCUMENTS

JP 2012103690 A 5/2012

* cited by examiner

*Primary Examiner* — Robert B Beatty
(74) *Attorney, Agent, or Firm* — Alleman Hall Creasman & Tuttle LLP

(57) ABSTRACT

A first guide member guides a sheet from a sending roller pair to a discharge port. A second guide member is disposed above the first guide member such that an upstream end of the second guide member in a sheet discharge direction overlaps the first guide member, and forms an upper partition of a discharge path in an area extending from a position above an end of the first guide member to a position of a discharge roller pair. The second guide member guides the sheet to the discharge roller pair. A cooling fan blows air from below the discharge path toward a lower surface of the second guide member. The lower surface of the second guide member is formed convexly curved upward when viewed in a width direction intersecting the sheet discharge direction. The lower surface of the second guide member guides air toward the first guide member.

5 Claims, 3 Drawing Sheets

IMAGE FORMING APPARATUS WITH FAN FOR COOLING DISCHARGED SHEET

INCORPORATION BY REFERENCE

This application is based upon and claims the benefit of priority from the corresponding Japanese Patent Application No. 2021-102930 filed on Jun. 22, 2021, the entire contents of which are incorporated herein by reference.

BACKGROUND

The present disclosure relates to an image forming apparatus including a fan for cooling a discharged sheet.

An electrophotographic image forming apparatus includes a fixing device for fixing a toner image on a sheet by heating and pressing the toner image on the sheet.

If toner on the sheet rubs against a guide member that guides the sheet when the toner is at a high temperature, the image is likely to be disturbed. Further, if a plurality of sheets overlap each other on a discharge tray when toner on the sheet is at a high temperature, the toner is likely to be fused to another sheet.

Therefore, it is known that the image forming apparatus includes a cooling fan that blows air to the sheet that has passed through the fixing device. Thus, the toner on the sheet is cooled.

SUMMARY

An image forming apparatus according to one aspect of the present disclosure includes an image forming portion, a fixing portion, a sheet conveying portion, and a cooling fan. The image forming portion forms a toner image on a sheet. The fixing portion fixes the toner image on the sheet by heating and pressing while conveying the sheet. The sheet conveying portion includes a conveying path passing through the image forming portion and the fixing portion to a discharge port formed diagonally above the fixing portion. The sheet conveying portion conveys the sheet along the conveying path in a sheet discharge direction and discharges the sheet from the discharge port. The cooling fan blows air to the sheet that has passed through the fixing portion. The conveying path includes a discharge path and a reverse conveying path. The discharge path forms a passage for the sheet from the fixing portion to the discharge port. The reverse conveying path branches off from the discharge path and forms a passage for the sheet reversely conveyed from the discharge port. The sheet conveying portion includes a sending roller pair, a discharge roller pair, a first guide member, and a second guide member. The sending roller pair is disposed above the fixing portion, takes over the conveyance of the sheet from the fixing portion, and sends out the sheet to the discharge port. The discharge roller pair is disposed at an end of the discharge path in the discharge port, takes over the conveyance of the sheet from the sending roller pair, and discharges the sheet from the discharge port. The first guide member guides the sheet sent out from the sending roller pair to the discharge port. The second guide member is disposed above the first guide member such that an upstream side end portion of the second guide member in the sheet discharge direction overlaps the first guide member, and forms an upper partition of the discharge path in an area extending from a position above an end of the first guide member to a position of the discharge roller pair and guides the sheet sent out from the sending roller pair to the discharge roller pair. The cooling fan blows cooling air from below the discharge path through the discharge path toward a lower surface of the second guide member. The lower surface of the second guide member is formed to be convexly curved upward as viewed in a width direction intersecting the sheet discharge direction, and guides the cooling air from the discharge path toward the reverse conveying path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment will be described with reference to the drawings. It is noted that the following embodiment is an example of embodying the present disclosure and does not limit the technical scope of the present disclosure.

[Configuration of Image Forming Apparatus 10]

An image forming apparatus 10 according to the embodiment includes a printing device 4 that performs a printing process of forming an image on a sheet 9.

The printing device 4 performs the printing process using an electrophotographic method. The sheet 9 is an image forming medium such as paper or a sheet-like resin member.

Figure 1:
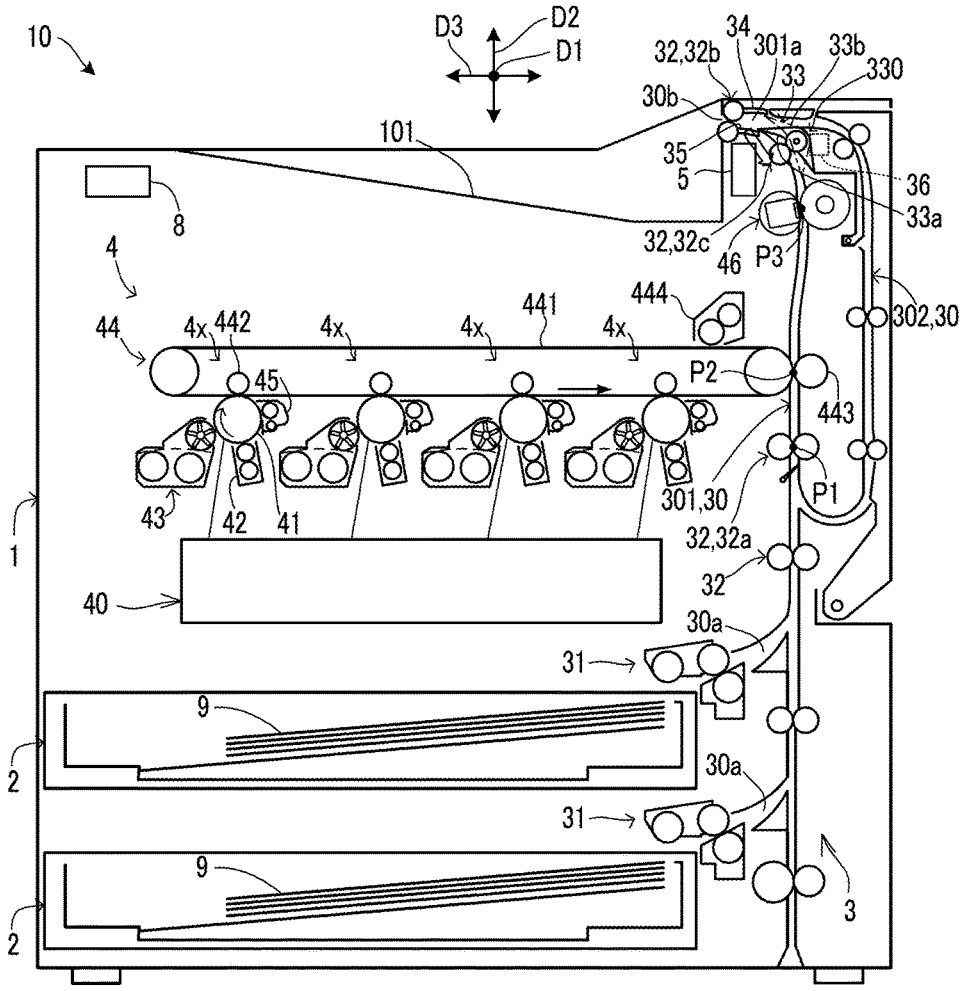
FIG. 1 is a configuration diagram of an image forming apparatus according to an embodiment.

As shown in FIG. 1, the image forming apparatus 10 includes a sheet conveying device 3 and a printing device 4 provided in a main body 1. Further, the image forming apparatus 10 includes a control device 8 that controls the sheet conveying device 3 and the printing device 4. The main body 1 is a housing that houses the sheet conveying device 3, the printing device 4, and the like.

The printing device 4 includes one or more image forming devices 4*x*, an laser scanning unit 40, a transfer device 44, and a fixing device 46. The image forming devices 4*x* each include a drum-shaped photoconductor 41, a charging device 42, a developing device 43, and a drum cleaning device 45.

The sheet conveying device 3 includes a conveying path 30, a sheet feed device 31, and a plurality of conveying roller pairs 32. Further, the sheet conveying device 3 includes a drive device (not shown) that drives the sheet feed device 31 and the conveying roller pairs 32. The sheet conveying device 3 is an example of a sheet conveying portion.

The sheet feed device 31 feeds a sheet 9 stored in a sheet storing portion 2 to the conveying path 30 in the main body 1. The conveying path 30 forms a passage through which the sheet 9 is conveyed.

The conveying roller pairs 32 are rotationally driven by the drive device. The conveying roller pairs 32 rotate while sandwiching the sheet 9, thereby conveying the sheet 9 along the conveying path 30.

The conveying path 30 includes a main conveying path 301 and a sub-conveying path 302. The main conveying path 301 is a path from a loading port 30*a* to a discharge port 30*b* via a resist position P1, a transfer position P2, and a fixing position P3. That is, the main conveying path 301 passes through the transfer device 44 and the fixing device 45.

In the present embodiment, the transfer position P2 is located above the resist position P1, and the fixing position P3 is located above the transfer position P2. In addition, the resist position P1 is located above the loading port 30*a*. The discharge port 30*b* is formed diagonally above the fixing position P3.

The sub-conveying path 302 branches off from a portion of the main conveying path 301 between the fixing position P3 and the discharge port 30*b* and merges with a portion of the main conveying path 301 on the upstream side of the resist position P1. The sub-conveying path 302 forms a passage for the sheet 9 reversely conveyed from the discharge port 30*b*. The sub-conveying path 302 is an example of a reverse conveying path.

The conveying roller pairs 32 include a resist roller pair 32*a* and a discharge roller pair 32*b*. Further, the conveying roller pairs 32 include a sending roller pair 32*c* disposed between the fixing position P3 and the position of the discharge roller pair 32*b* in the main conveying path 301.

The resist roller pair 32*a* temporarily stops the sheet 9 at the resist position P1 and then feeds the sheet 9 to the transfer position P2. By the action of the resist roller pair 32*a*, the timing at which the sheet 9 is fed to the transfer position P2 is adjusted.

The sending roller pair 32*c* is disposed above the fixing position P3. The sending roller pair 32*c* takes over the conveyance of the sheet 9 from the fixing device 46 and sends out the sheet 9 diagonally upward on the discharge port 30*b* side.

In the following description, a terminal portion of the main conveying path 301 will be referred to as a discharge path 301*a*. The discharge path 301*a* is located diagonally on the discharge port 30*b* side above the sending roller pair 32*c*. The discharge path 301*a* forms a passage for the sheet 9 from the fixing device 46 to the discharge port 30*b*. The sending roller pair 32*c* sends out the sheet 9 to the discharge path 301*a*.

Figure 2:
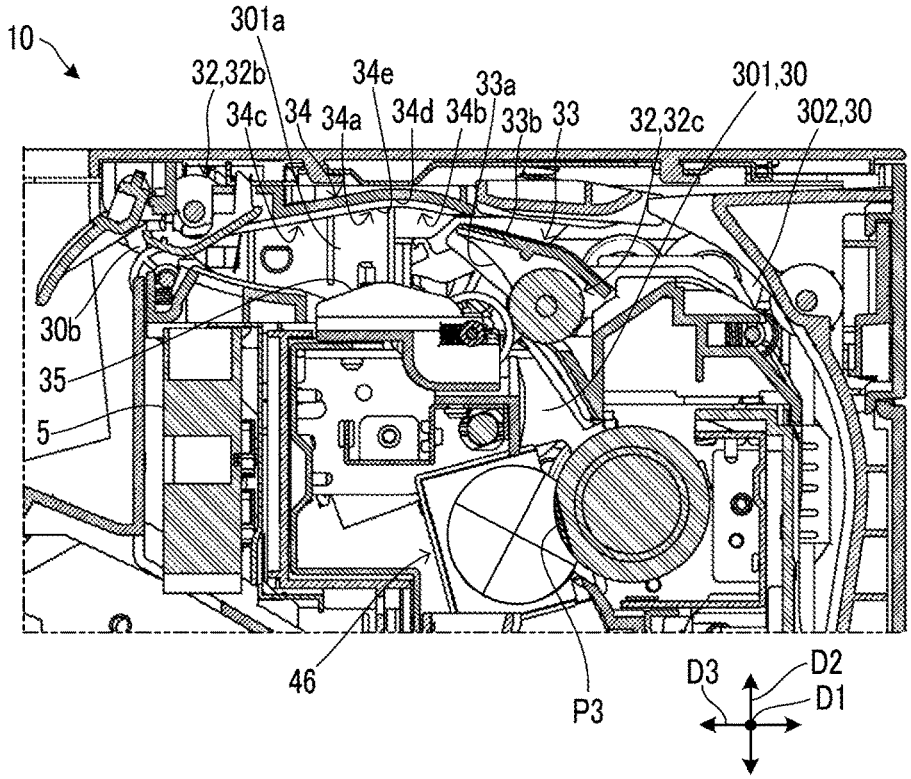
FIG. 2 is a cross-sectional view of a peripheral portion of a discharge path in the image forming apparatus according to the embodiment.

The sheet conveying device 3 further includes an upper discharge guide member 34 and a lower discharge guide member 35 (see FIG. 1 and FIG. 2). The upper discharge guide member 34 and the lower discharge guide member 35 form the discharge path 301*a* therebetween.

The upper discharge guide member 34 and the lower discharge guide member 35 guide the sheet 9 sent out from the sending roller pair 32*c* to the discharge roller pair 32*b*.

The discharge roller pair 32*b* is disposed at an end of the main conveying path 301 on the discharge port 30*b* side. That is, the discharge roller pair 32*b* is disposed at a terminal end of the discharge path 301*a*. The discharge roller pair 32*b* takes over the conveyance of the sheet 9 from the sending roller pair 32*c* and discharges the sheet 9 from the discharge port 30*b*.

The discharge roller pair 32*b* rotates in a first rotational direction to discharge the sheet 9 passing through the discharge path 301*a* from the discharge port 30*b* of the main conveying path 301 onto the discharge tray 101. The discharge roller pair 32*b* rotates in a second rotational direction to reversely convey the sheet 9.

The sheet conveying device 3 further includes a path switching mechanism 330. The path switching mechanism 330 includes a movable guide member 33 and an actuator 36 such as a solenoid. The movable guide member 33 is swingably supported by the main body 1.

The actuator 36 swings the movable guide member 33 between a first position and a second position. Specifically, the actuator 36 selectively disposes the movable guide member 33 to one of the first position and the second position. The movable guide member 33 has a first guide surface 33*a* and a second guide surface 33*b*. The second guide surface 33*b* is formed on the back side of the first guide surface 33*a* in the movable guide member 33.

The initial position of the movable guide member 33 is the first position. In FIG. 1, the movable guide member 33 disposed at the first position is shown by a solid line. In addition, the movable guide member 33 disposed at the second position is shown by a dash-dot-dot-dash line.

Figure 3:
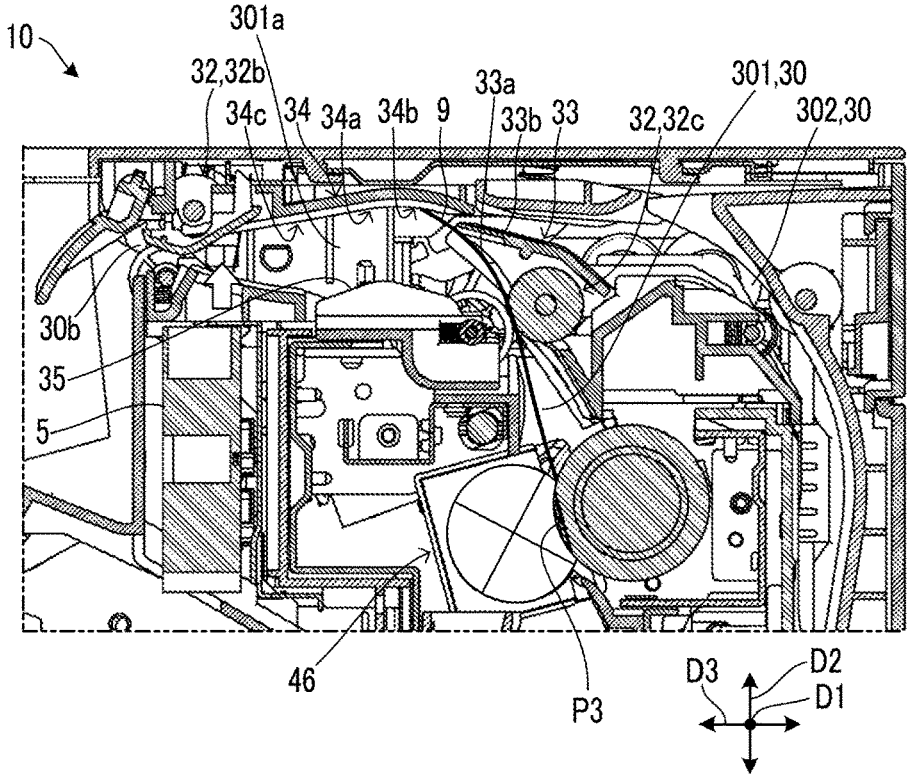
FIG. 3 shows a peripheral portion of the discharge path when a sheet sent out from a sending roller pair to the discharge path in the image forming apparatus according to the embodiment.
Figure 4:
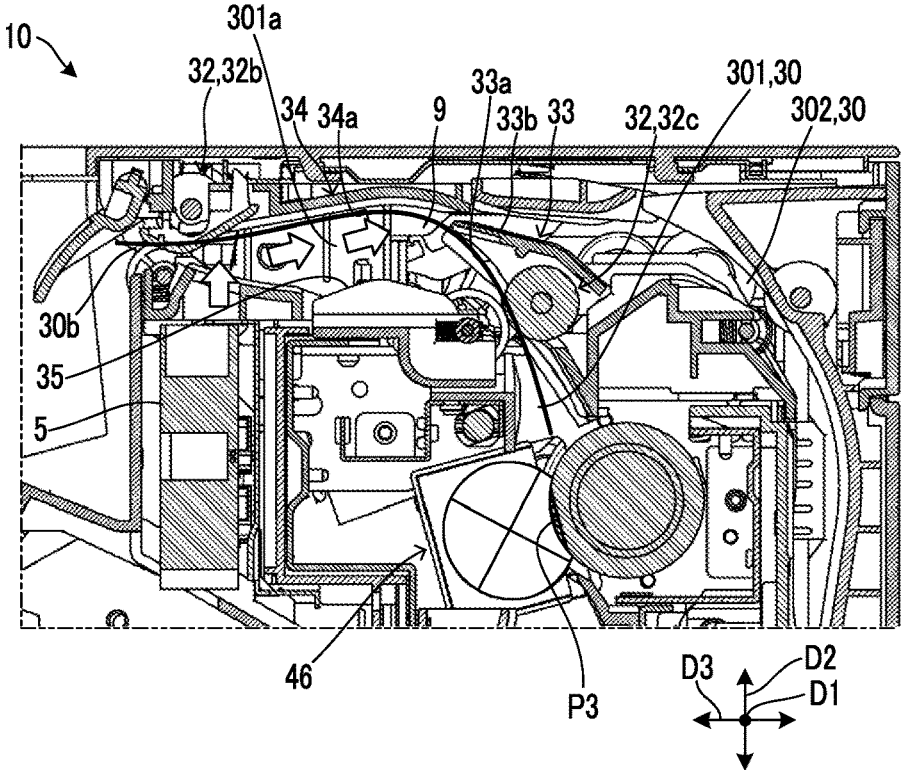
FIG. 4 shows a peripheral portion of the discharge path when a sheet is passing through the discharge path in the image forming apparatus according to the embodiment.
Figure 5:
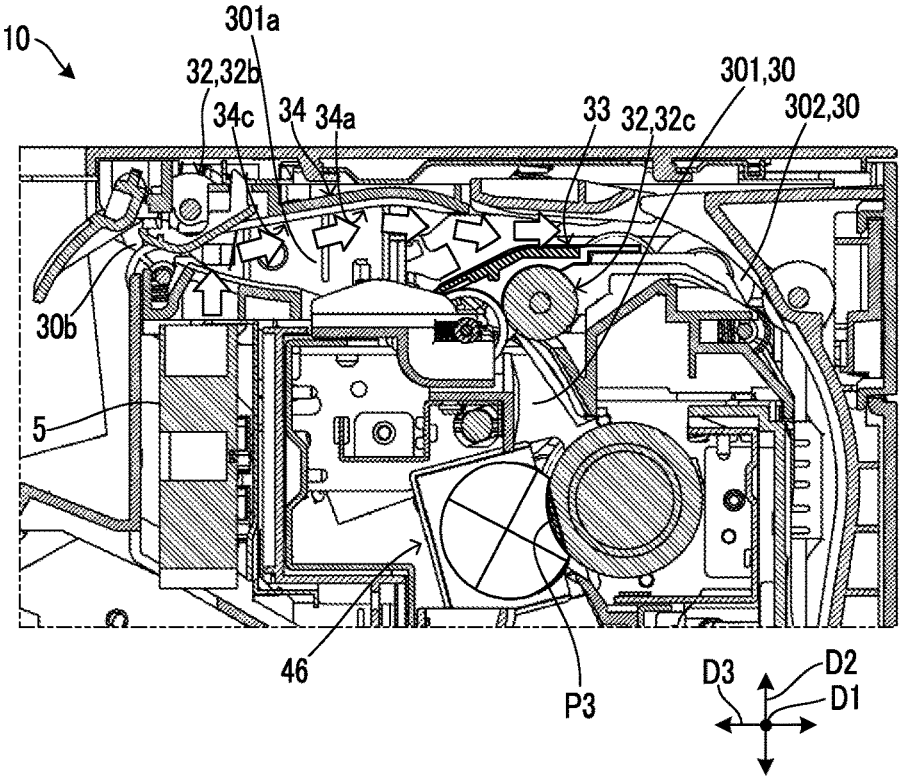
FIG. 5 shows a peripheral portion of the discharge path when no sheet is present in the discharge path in the image forming apparatus according to the embodiment.

FIG. 3 and FIG. 4 show the movable guide member 33 disposed at the second position. FIG. 5 shows the movable guide member 33 disposed at the first position.

When the movable guide member 33 is present at the second position, the movable guide member 33 connects the path from the sending roller pair 32*c* to the discharge port 30*b* in the main conveying path 301. When the movable guide member 33 is present at the second position, the movable guide member 33 guides the sheet 9 sent out from the sending roller pair 32*c* diagonally upward on the discharge port 30*b* side.

Specifically, when the movable guide member 33 is disposed at the second position, the movable guide member 33 guides the sheet 9 conveyed by the sending roller pair 32*c* toward the upper discharge guide member 34 by the first guide surface 33*a*.

The movable guide member 33 is an example of a first guide member. The upper discharge guide member 34 is an example of a second guide member.

Further, when the movable guide member 33 is at the first position, the movable guide member 33 connects the path from the discharge port 30*b* of the main conveying path 301 to the sub-conveying path 302. When the movable guide member 33 is disposed at the second position, the movable guide member 33 blocks the path from the discharge path 301*a* to the sending roller pair 32*c*, and guides the sheet 9 reversely conveyed by the discharge roller pair 32*b* to the sub-conveying path 302 by the second guide surface 33*b*.

When the sheet 9 is conveyed along the sub-conveying path 302, some of the conveying roller pairs 32 feed the sheet 9 to the resist position P1 of the main conveying path 301 again.

The printing device 4 forms a toner image on the sheet 9 conveyed along the main conveying path 301 by the sheet conveying device 3. The toner image is a developer image using toner as a developer. The toner is granular and is an example of the developer.

The image forming apparatus 10 shown in FIG. 1 is a tandem type color image forming apparatus. Therefore, the printing device 4 includes a plurality of image forming devices 4*x* corresponding to toners of a plurality of colors. In the present embodiment, the printing device 4 includes four image forming devices 4*x* corresponding to four colors of yellow, cyan, magenta, and black.

In each of the image forming devices 4*x*, the photoconductor 41 rotates, and the charging device 42 charges the surface of the photoconductor 41. Further, the laser scanning unit 40 writes an electrostatic latent image on the surface of the photoconductor 41 by scanning with a laser beam.

Further, the developing device 43 supplies the toner to the surface of the photoconductor 41 to develop the electrostatic latent image as the toner image. The photoconductor 41 is an example of an image carrier that rotates while carrying the toner image.

The transfer device 44 transfers the toner image to the sheet 9 at the transfer position P2 of the conveying path 30. The transfer device 44 includes an intermediate transfer belt 441, four primary transfer devices 442 corresponding to the four image forming devices 4*x*, a secondary transfer device 443, and a belt cleaning device 444.

In the transfer device 44, the primary transfer devices 442 transfer the toner image on the surface of the photoconductor 41 to the surface of the intermediate transfer belt 441. Thus, the toner image is formed in color on the surface of the intermediate transfer belt 441.

The secondary transfer device 443 transfers the toner image formed on the intermediate transfer belt 441 to the sheet 9 at the transfer position P2 of the main conveying path 301. One or more of the image forming devices 4*x*, the laser scanning unit 40, and the transfer device 44 are an example of an image forming portion configured to form the toner image on the sheet 9.

It is noted that, when the image forming apparatus 10 is a monochrome image forming apparatus, the secondary transfer apparatus 443 transfers the toner image on the photoconductor 41 to the sheet 9 at the transfer position P2.

The drum cleaning device 45 removes waste toner remaining on the surface of the photoconductor 41. The belt cleaning device 444 removes the waste toner remaining on the intermediate transfer belt 441.

The fixing device 46 heats and presses the toner image on the sheet 9 while conveying the sheet 9, at the fixing position P3 of the main conveying path 301. Thus, the fixing device 46 fixes the toner image on the sheet 9. The fixing device 46 is an example of a fixing portion.

The control device 8 includes a central processing unit (CPU) (not shown). Further, the control device 8 includes a random access memory (RAM) which is a peripheral device of the CPU, a secondary storage device, a signal interface, and the like.

By the CPU executing a computer program stored in the secondary storage device, the control device 8 controls the conveyance of the sheet 9 by the sheet conveying device 3 and the printing process by the printing device 4. The control device 8 is an example of a control portion configured to control conveyance of the sheet 9.

In each figure, the width direction D1 is a horizontal direction that intersects a sheet conveying direction that extends along the conveying path 30. In addition, the vertical direction D2 is an up-down direction.

The discharge path 301*a* and an introduction portion of the sub-conveying path 302 are formed along a lateral direction D3 that intersects the width direction D1 and the vertical direction D2.

If toner on a sheet 9 rubs against a guide member that guides the sheet 9 when it is at a high temperature, the image is likely to be disturbed. Further, if a plurality of sheets 9 overlap each other on a discharge tray 101 when the toner on the sheet 9 is at a high temperature, the toner is likely to be fused to another sheet.

Therefore, the image forming apparatus 10 includes a cooling fan 5 that blows air to the sheet 9 that has passed through the fixing position P3 (see FIG. 1). In the present embodiment, the cooling fan 5 is disposed below the discharge roller pair 32*b*.

After passing through the fixing device 46, the sheet 9 is discharged from the discharge path 301*a* through the discharge port 30*b* onto the discharge tray 101 by the discharge roller pair 32*b*. As described above, the discharge path 301*a* is a terminal portion of the main conveying path 301.

In the present embodiment, the cooling fan 5 blows air from below the discharge path 301*a* toward the discharge path 301*a*. In this case, the cooling air efficiently cools the high-temperature toner on the sheet 9. In addition, the wind of the cooling fan 5 is prevented from adversely affecting the fixing device 46.

On the other hand, when the sheet 9 is not present in the discharge path 301*a*, the wind of the cooling fan 5 may escape from the discharge path 301*a* through the discharge port 30*b* to the outside of the apparatus. In this case, when the sheet 9 is not present in the discharge path 301*a*, the wind of the cooling fan 5 is not effectively utilized.

The image forming apparatus 10 has a structure for effectively utilizing the wind of the cooling fan 5 for purposes other than cooling the toner on the sheet 9. Hereinafter, the structure will be described.

The upper discharge guide member 34 is formed in an area extending from a position above an end of the movable guide member 33 in a sheet discharge direction to the position of the discharge roller pair 32*b*. The upper discharge guide member 34 is disposed above the movable guide member 33 such that an upstream side end portion of the upper discharge guide member 34 in the sheet discharge direction overlaps the movable guide member 33. The upper discharge guide member 34 forms an upper partition of the discharge path 301*a* (see FIG. 2). The sheet discharge direction extends along the lateral direction D3.

A lower surface 34*a* of the upper discharge guide member 34 is formed to be convexly curved upward as viewed in the width direction D1 intersecting the sheet discharge direction (see FIG. 1). That is, the lower surface 34*a* of the upper discharge guide member 34 includes a front inclined portion 34*b* and a rear inclined portion 34*c*.

The front inclined portion 34*b* is inclined diagonally upward in the sheet discharge direction from the end on the movable guide member 33 side. The rear inclined portion 34*c* is continuous with the front inclined portion 34*b* on the sheet discharge direction side.

The rear inclined portion 34*c* is inclined diagonally downward in the sheet discharge direction from the portion continuous with the front inclined portion 34*b*.

The lower surface 34*a* of the upper discharge guide member 34 includes a base surface 34*d* and a plurality of guide ribs 34*e*. Each of the guide ribs 34*e* projects downward from the base surface 34*d* and is formed along the sheet discharge direction. The base surface 34*d* and the guide ribs 34*e* are each formed to be convexly curved upward as viewed in the width direction D1.

As shown in FIG. 3, at the second position, the movable guide member 33 guides the leading end of the sheet 9 sent out from the sending roller pair 32*c* to the front inclined portion 34*b* by the first guide surface 33*a*. After passing through the first guide surface 33*a*, the leading end of the sheet 9 first comes into contact with the front inclined portion 34*b*.

The peripheral speed of the discharge roller pair 32*b* when the discharge roller pair 32*b* rotates in the first rotational direction is lower than the peripheral speed of the sending roller pair 32*c*. Therefore, as shown in FIG. 4, the sheet 9 convexly curves upward in the discharge path 301*a*. Therefore, the sheet 9 is less likely to rub against the lower discharge guide member 35.

In addition, in the discharge path 301*a*, the sheet 9 curves into a shape close to the shape of the lower surface 34*a* of the upper discharge guide member 34 (see FIG. 4). Thus, the sheet 9 is also less likely to rub against the upper discharge guide member 34.

When the sheet 9 is not present in the discharge path 301*a*, the cooling fan 5 blows the cooling air from below the discharge path 301*a* to the lower surface 34*a* of the upper discharge guide member 34 through the discharge path 301*a* (see FIG. 5).

As shown in FIG. 5, when the sheet 9 is not present in the discharge path 301*a*, the wind of the cooling fan 5 is guided to the upstream side in the sheet discharge direction by the rear inclined portion 34*c*. In FIG. 5, the white arrows indicate a direction in which the wind of the cooling fan 5 flows. That is, the lower surface 34*a* of the upper discharge guide member 34 guides the wind of the cooling fan 5 from the discharge path 301*a* toward the sub-conveying path 302.

Accordingly, when the sheet 9 is not present in the discharge path 301*a*, the wind of the cooling fan 5 is effectively utilized for cooling the upper discharge guide member 34, the lower discharge guide member 35, and the movable guide member 33. That is, the guide members around the discharge path 301*a* are cooled.

Since the guide members are cooled, the image is not likely to be disturbed even when the toner on the sheet 9 rubs against the guide members.

The control device 8 executes first control when the sheet 9 sent out from the sending roller pair 32*c* is guided to the discharge roller pair 32*b*. In the first control, the control device 8 causes the actuator 36 to perform an operation to dispose the movable guide member 33 at the second position and rotates the discharge roller pair 32*b* in the first rotational direction.

Further, the control device 8 executes second control when the sheet 9 is guided to the sub-conveying path 302 branching off from the discharge path 301*a*. In the second control, the control device 8 rotates the discharge roller pair 32*b* in the second rotational direction and causes the actuator 36 to execute an operation to dispose the movable guide member 33 at the first position.

In the present embodiment, the control device 8 causes the actuator 36 to execute an operation to swing the movable guide member 33 from the second position to the first position every time the sheet 9 passes through the position corresponding to the movable guide member 33.

When the movable guide member 33 is disposed at the first position, the movable guide member 33 blocks the passage of the cooling air from the discharge path 301*a* toward the sending roller pair 32*c*. Thus, the wind of the cooling fan 5 is prevented from adversely affecting the fixing device 46.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A image forming apparatus comprising:

an image forming portion configured to form a toner image on a sheet;

a fixing portion configured to fix the toner image on the sheet by heating and pressing while conveying the sheet;

a sheet conveying portion including a conveying path passing through the image forming portion and the fixing portion to a discharge port formed diagonally above the fixing portion, and configured to convey the sheet along the conveying path in a sheet discharge direction and discharge the sheet from the discharge port;

a cooling fan configured to blow air to the sheet that has passed through the fixing portion;

an actuator; and a control portion configured to control the conveyance of the sheet, wherein the conveying path includes:

a discharge path forming a passage for the sheet from the fixing portion to the discharge port; and a reverse conveying path branching off from the discharge path and forming a passage for the sheet reversely conveyed from the discharge port, the sheet conveying portion includes:

a sending roller pair disposed above the fixing portion, and configured to take over the conveyance of the sheet from the fixing portion and send out the sheet to the discharge port;

a discharge roller pair disposed at an end of the discharge path in the discharge port and configured to take over the conveyance of the sheet from the sending roller pair and discharge the sheet from the discharge port;

a first guide member configured to guide the sheet sent out from the sending roller pair to the discharge port; and a second guide member disposed above the first guide member such that an upstream side end portion of the second guide member in the sheet discharge direction overlaps the first guide member, forming an upper partition of the discharge path in an area extending from a position above an end of the first guide member to a position of the discharge roller pair and configured to guide the sheet sent out from the sending roller pair to the discharge roller pair, the cooling fan blows cooling air from below the discharge path through the discharge path toward a lower surface of the second guide member, the lower surface of the second guide member is formed to be convexly curved upward as viewed in a width direction intersecting the sheet discharge direction, and guides the cooling air from the discharge path toward the reverse conveying path, the actuator swings the first guide member between a first position and a second position, the first guide member is swingably supported and includes a first guide surface and a second guide surface formed on a back side of the first guide surface, when the sheet conveyed from the sending roller pair is guided to the discharge roller pair, the control portion causes the actuator to dispose the first guide member at the second position and to rotate the discharge roller pair in a first rotational direction, when the sheet conveyed by the discharge roller pair is guided from the discharge path to the reverse conveying path, the control portion rotates the discharge roller pair in a second rotational direction opposite to the first rotational direction and causes the actuator to dispose the first guide member at the first position, when the first guide member is disposed at the second position, the first guide member guides the sheet sent out by the sending roller pair toward the second guide member by the first guide surface, and when the first guide member is disposed at the first position, the first guide member blocks a passage of the cooling air from the discharge path toward the fixing portion, and guides the sheet reversely conveyed by the discharge roller pair to the reverse conveying path by the second guide surface.

2. The image forming apparatus according to claim 1, wherein the lower surface of the second guide member includes a plurality of guide ribs formed along the sheet discharge direction.

3. The image forming apparatus according to claim 1, wherein a peripheral speed of the discharge roller pair is lower than that of the sending roller pair.

4. The image forming apparatus according to claim 1, wherein the control portion causes the actuator to swing the first guide member from the second position to the first position each time the sheet passes through a position corresponding to the first guide member.

5. The image forming apparatus according to claim 1, wherein the cooling fan is disposed below the discharge roller pair.

* * * * *